US010236637B2

(12) United States Patent
Maesoba

(10) Patent No.: US 10,236,637 B2
(45) Date of Patent: Mar. 19, 2019

(54) COMMUNICATION CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Hiroyoshi Maesoba, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/567,219

(22) PCT Filed: Apr. 1, 2016

(86) PCT No.: PCT/JP2016/060893
§ 371 (c)(1),
(2) Date: Oct. 17, 2017

(87) PCT Pub. No.: WO2016/170954
PCT Pub. Date: Oct. 27, 2016

(65) Prior Publication Data

US 2018/0138640 A1 May 17, 2018

(30) Foreign Application Priority Data

Apr. 21, 2015 (JP) ..... 2015-086921

(51) Int. Cl.
*H01R 13/6593* (2011.01)
*H01R 24/60* (2011.01)
*H01R 13/6581* (2011.01)

(52) U.S. Cl.
CPC ..... *H01R 13/6593* (2013.01); *H01R 13/6581* (2013.01); *H01R 24/60* (2013.01)

(58) Field of Classification Search
CPC ..... H01R 9/0506; H01R 13/6592
(Continued)

(56) References Cited

U.S. PATENT DOCUMENTS 2,804,601 A * 8/1957 Harwood ..... H01R 13/621 439/579
2,827,618 A * 3/1958 Dixon ..... B29C 45/14639 264/271.1

(Continued)

FOREIGN PATENT DOCUMENTS

JP 2002-135938 5/2002
JP 2003-77593 3/2003

(Continued)

OTHER PUBLICATIONS

International Search Report dated Jun. 28, 2016.

*Primary Examiner* — Tulsidas C Patel
*Assistant Examiner* — Marcus Harcum
(74) *Attorney, Agent, or Firm* — Gerald E. Hespos; Michael J. Porco; Matthew T. Hespos

(57) ABSTRACT

A communication connector includes a wires (11, 12, 13, 14) for transmitting communication signals, terminals (20) to be connected to the respective wires (11, 12, 13, 14), a housing (30) for accommodating the terminals (20) and an insulation coating (15) for collectively covering the wires (11, 12, 13, 14). An end part of each wire (11, 12, 13, 14) on the side of the terminal (20) is exposed and not covered with the insulation coating (15). A conductive first shield member (61) is interposed between two adjacent wires (11A, 11B) and the insulation coating (15), and a conductive second shield member (62) surrounds exposed parts (19A, 19B) of (Continued)

the wires (11A, 11B). The first and second shield members (61, 62) are connected electrically.

3 Claims, 8 Drawing Sheets

(58) Field of Classification Search
USPC ..... 439/579, 607.41, 607.45, 607.48
See application file for complete search history.

(56) References Cited

U.S. PATENT DOCUMENTS 3,078,436 A * 2/1963 Berry ..... H01R 13/6588 439/579
3,825,874 A * 7/1974 Peverill ..... H01R 24/568 439/579
4,974,075 A * 11/1990 Nakajima ..... A61B 1/00124 348/75
5,505,637 A * 4/1996 Kramer ..... H01R 13/6581 439/467
7,452,238 B1 * 11/2008 Wu ..... H01R 12/592 439/579
7,651,379 B1 * 1/2010 Wu ..... H01R 12/62 439/108
7,717,733 B1 * 5/2010 Yi ..... H01R 13/58 439/452
2002/0050386 A1 5/2002 Aizawa et al.
2003/0064625 A1 * 4/2003 Ozai ..... H01R 9/032 439/579
2006/0014431 A1 1/2006 Shuey et al.
2015/0214672 A1 * 7/2015 Wu ..... H01R 12/775 439/579
2015/0255928 A1 * 9/2015 Liptak ..... H01R 13/6581 439/357
2016/0036170 A1 * 2/2016 Dunwoody ..... H01R 13/6592 439/607.41

FOREIGN PATENT DOCUMENTS

JP 2004-235083 8/2004
JP 2005-038617 2/2005
JP 2008-507110 3/2008
JP 2009-302002 12/2009

* cited by examiner

COMMUNICATION CONNECTOR

BACKGROUND

Field of the Invention

The invention relates to a communication connector.

Description of the Related Art

Japanese Unexamined Patent Publication No. 2008-507110 discloses an electrical connector capable of receiving four USB plug connectors. This electrical connector includes a housing and a plurality of electrical contacts bent into an L shape and made of metal.

Some known electrical connectors are configured such that an end parts of wires are connected respectively to electrical contacts. Further, the wires collectively are surrounded by a shield layer and an insulation layer. In connecting such wires to the electrical contacts, the shield layer and the insulation coating need to be stripped at the end parts of the wires. This causes parts not covered with the shield layer to be formed at the end parts of the wires and an impedance changes with respect to parts covered with the shield layer. It is concerned that signal reflection occurs to reduce communication quality at an impedance changing point.

The invention was completed based on the above situation and aims to suppress a situation where communication quality is reduced.

SUMMARY

The invention is directed to a communication connector with wires for transmitting communication signals, terminals to be connected to the respective wires, and a housing for accommodating the terminals. An insulation coating collectively covers the wires, but an end part of each wire on the terminal side is exposed and not covered with the insulation coating. A conductive first shield member is interposed between at least one of the wires and the insulation coating, and a conductive second shield member surrounds the exposed part of the one wire. The first and second shield members are connected electrically.

According to the invention, the end part of the wire on the terminal side is exposed and not covered with the insulation coating. This enables each wire to be bent easily at the end part and easily connected to each terminal. The exposed part of the one wire is covered with the second shield member and the second shield member is electrically connected to the first shield member. This can suppress a situation where an impedance changes between a part covered with the insulation coating and the exposed part, and can suppress a reduction of communication quality.

The wires may include a drain wire to be connected electrically to the first shield member. This configuration further reduces the influence of noise by electrically connecting the drain wire to ground.

The wires may include a wire adjacent to the one wire. The one wire and the adjacent wire may constitute a twisted pair cable by being twisted with each other in a part covered with the insulation coating, and the second shield member may be configured to surround the one wire and the adjacent wire. This configuration reduces noise relating to the one wire and the adjacent.

According to the present invention, it is possible to suppress a situation where communication quality is reduced.

DETAILED DESCRIPTION

One embodiment of the invention is described with reference to FIGS. 1 to 9. A communication connector 10 of this embodiment is installed in a vehicle such as an electric or hybrid vehicle and disposed, for example, in a wired communication path between an in-vehicle electrical component (car navigation system, ETC, monitor or the like) in the vehicle and an external device (camera or the like) or between in-vehicle electrical components. In the following description, left and right sides of FIG. 3 are referred to as front and rear sides concerning a front-rear direction (Z axis), upper and lower sides of FIG. 3 are referred to as left and right sides concerning a lateral direction (X axis) and a vertical direction (Y axis) is based on FIG. 5.

Figure 2:
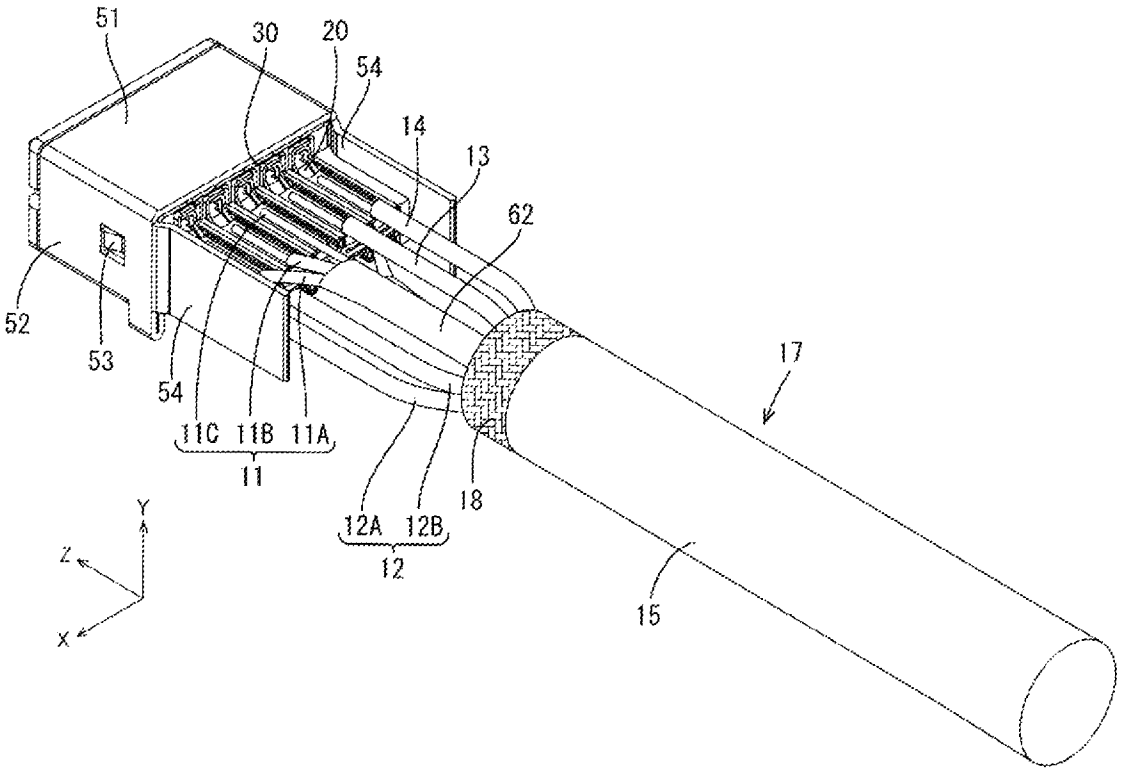
FIG. 2 is a perspective view showing the communication connector in a state where a second shield case is removed.

The communication connector 10 of this embodiment includes, as shown in FIG. 2, a shield cable 17, terminals 20 to be connected respectively to wires 11 to 14 constituting the shield cable 17, a housing 30 for accommodating the terminals 20, and a shield case 50 for covering the housing 30 and the shield cable 17.

(Shield Cable 17)

Figure 3:
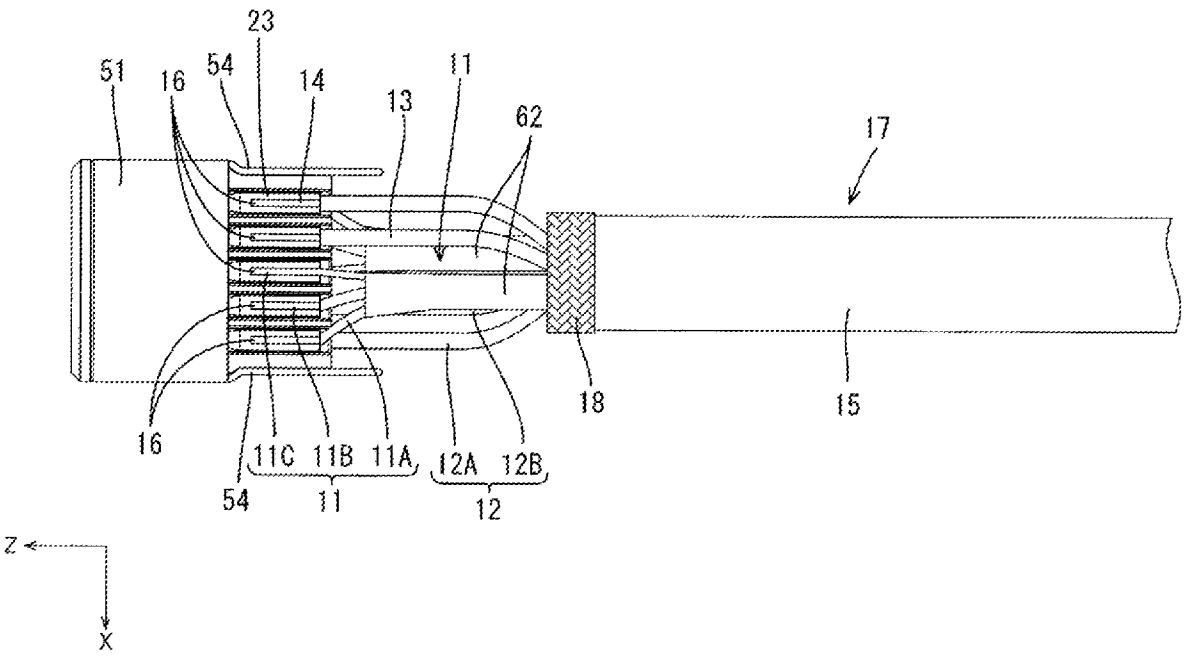
FIG. 3 is a plan view showing the communication connector in the state where the second shield case is removed.

The shield cable 17 is capable of high-speed communication of 1 GHz or faster and includes, as shown in FIGS. 2 and 3, wires 11 to 14 for transmitting communication signals, a shield layer 18 (also see FIG. 9) collectively surrounding the wires 11 to 14 and constituted by a braided wire formed by braiding thin metal wires and an insulation coating 15 (sheath) covering the outer periphery of the shield layer 18 and made of insulating synthetic resin. Further, a filling member (not shown) composed of insulating threads or paper tape is filled between the wires 11 to 14 and the shield layer 18.

Figure 9:
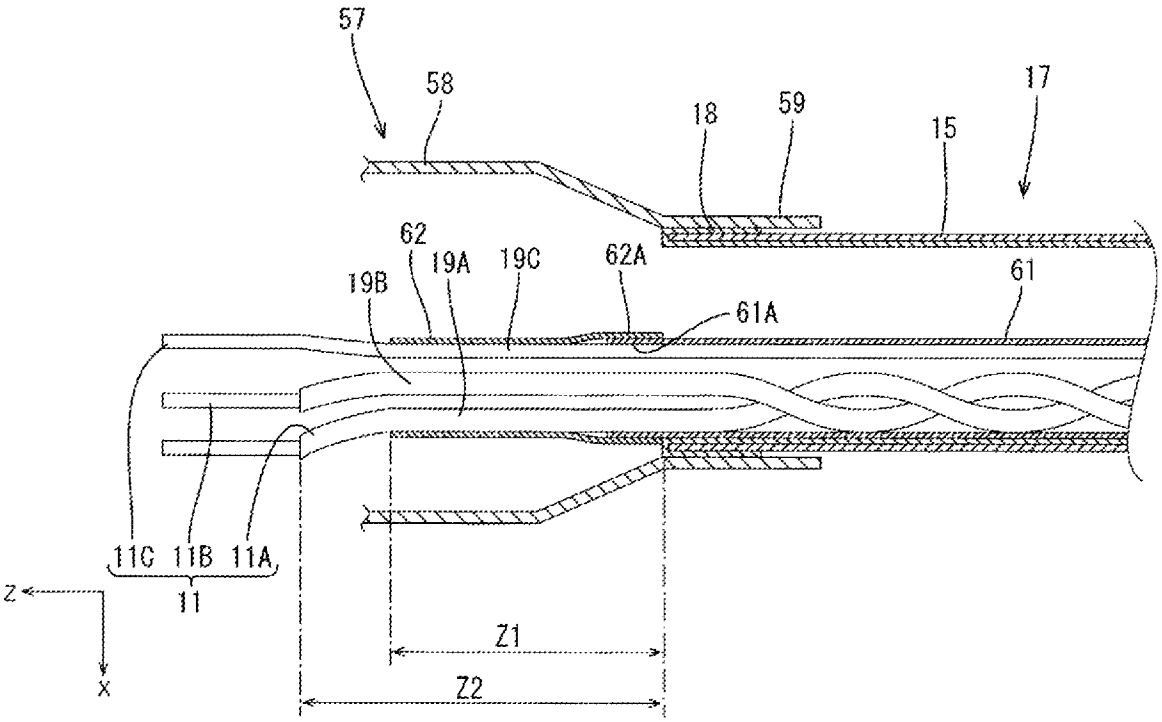
FIG. 9 is a section showing the shield cable.

The wires 11 are of a differential pair cable with a shield and a drain wire. As shown in FIG. 9, the wires 11 include first and second wires 11A, 11B and a drain wire 11C. The first and second wires 11A, 11B are adjacent to each other, as shown in FIG. 9, and constitute a twisted pair cable by being twisted with each other in a part covered with the insulation coating 15. The wires 11 are, for example, wires of USB (Universal Serial Bus) 3.0 standard and two sets of wires 11 are provided.

The wires 12 are for communication having a lower maximum data transfer speed than communication using the wires 11 and constitute a twisted pair cable without shield. As shown in FIG. 2, the wires 12 include wires 12A, 12B and are of USB 2.0 standard. The wires 12A, 12B constitute a twisted pair cable by being twisted with each other in the part covered with the insulation coating 15.

The wire 13 is a power supply wire connected to an unillustrated power supply, and the wire 14 is a ground wire connected to ground. As just described, the shield cable 17 of this embodiment is composed of a total of ten wires, i.e. two sets of the wires 11 (wires 11A, 11B and drain wires 11C), one set of wires 12 (wires 12A, 12B), the wire 13 and the wire 14.

As shown in FIG. 2, in this embodiment, one set of the wires 11, out of two sets of the wires 11, and the wires 13, 14 are aligned laterally in a row and the other set of the wires 11 and the wires 12 are aligned laterally in a row below the former wires. Further, the one set of the wires 11 and the other set of the wires 11 are disposed at positions diagonal to each other. Note that, in FIG. 9, only the wires 11 on an upper side are shown and the other wires are not shown.

End parts of the wires 11 to 14 on the side of the terminals 20 are exposed and are not covered with the shield layer 18 and the insulation coating 15. This enables the respective wires 11 to 14 to be bent at the end parts independently of each other and easily connected to the respective terminals 20.

Each wire 12 to 15 excluding the drain wires 11C is configured such that a conductor made of a metal wire is covered with an insulation layer made of insulating synthetic resin, and the end part on the terminal side has the insulation layer stripped to expose the conductor to be connected to the terminal 20. The drain wire 11C is composed of a conductor made of a metal wire, but may be composed of a conductor and an insulation layer.

As shown in FIG. 9, the wires 11A, 11B and the drain wire 11C are surrounded by a first shield member 61 and a second shield member 62. The first shield member 61 is a conductive thin film and a metal tape called Al-Pet (registered trademark) can be, for example, used as such. Al-Pet is formed by laminating an aluminum foil and polyethylene terephthalate via polyvinyl chloride (PVC) or the like and molding the laminate into a tape.

The first shield member 61 is interposed between the wires 11A, 11B and the drain wire 11C and the insulation coating 15. The second shield member 62 is a conductive thin film and a copper foil or the like can be, for example, used as such. The second shield member 62 is wound on exposed parts 19A, 19B, 19C (parts not covered with the insulation coating 15) of the wires 11A, 11B and the drain wire 11C. Further, an unillustrated adhesive layer is provided on the inner peripheral surface of the second shield member 62 and adhered to the wires 11A, 11B and the drain wire 11C.

An end part 61A of the first shield member 61 is exposed from the insulation coating 15, and the second shield member 62 is disposed such that an end part 62A thereof overlaps on the end part 61A of the first shield member 61. That is, the inner peripheral surface of the end part 62A is in contact with the outer peripheral surface of the end part 61A. The drain wire 11C is in contact with the both inner peripheral surfaces of the first and second shield members 61, 62. In this way, the drain wire 11C, the first shield member 61 and the second shield member 62 are connected electrically.

(Terminal 20)

Figure 4:
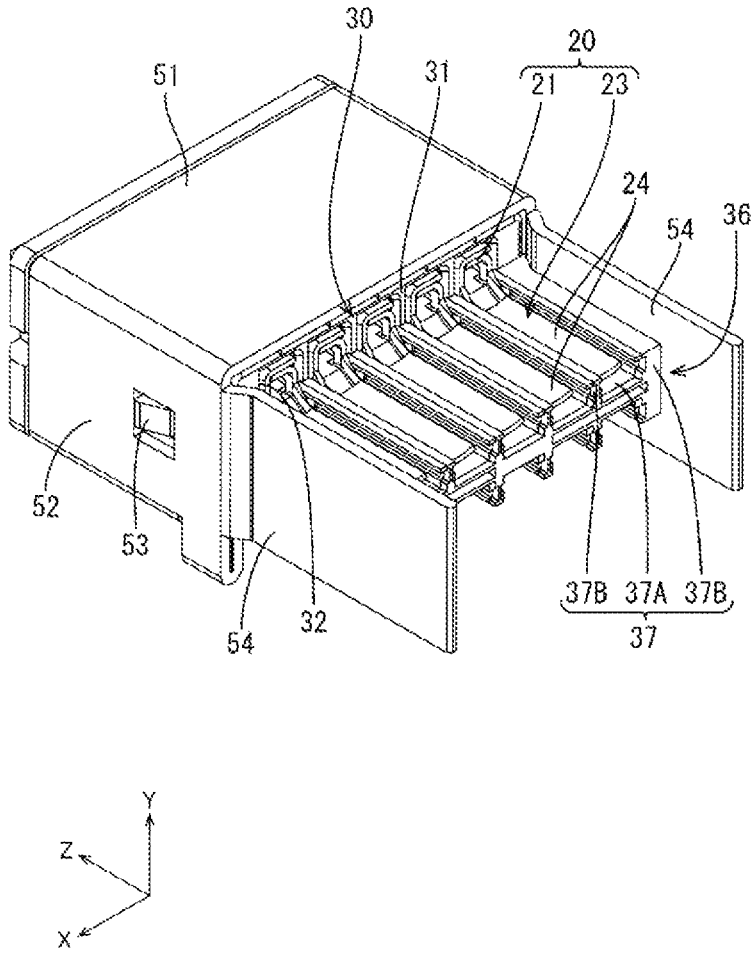
FIG. 4 is a perspective view showing the communication connector in a state where the second shield case and a shield cable are removed.
Figure 5:
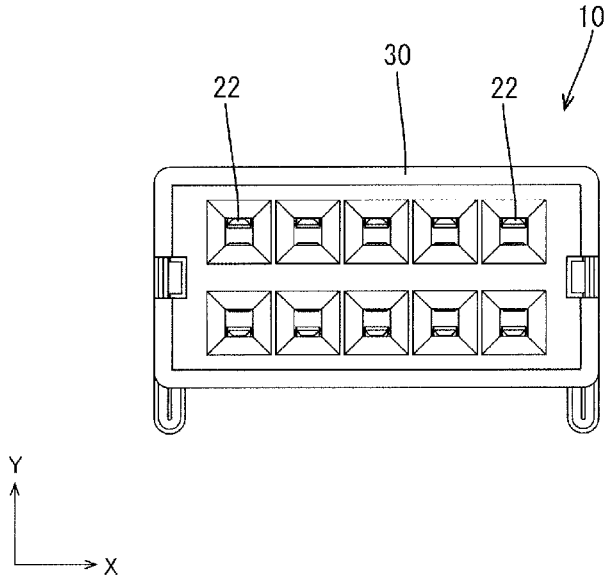
FIG. 5 is a front view showing the communication connector.

As shown in FIG. 4, a rectangular tubular terminal connecting portion 21 is formed at the front side of the terminal 20. A wire connecting portion 23 is formed integrally behind the terminal connecting portion 21 and is to be connected to the conductor part of the wire 11 to 14. The terminal connecting portion 21 is provided with a resilient contact piece 22 (see FIG. 5) to be connected to a male terminal of a mating connector. The wire connecting portion 23 includes a bottom plate 24, and the conductor part of the wire 11 to 14 is connected electrically to the wire connecting portion 23, for example, by being soldered or welded to the bottom plate 24.

(Housing 30)

The housing 30 is made of insulating synthetic resin and, as shown in FIG. 4, includes a housing body 31 for accommodating the terminal connecting portions 21 of the respective terminals 20 and an extending portion 36 extending behind the housing body 31 and having a smaller thickness. The housing body 31 has a rectangular parallelepiped shape and includes cavities 32 for accommodating the terminals 20. Five cavities 32 arranged in the lateral direction are provided in each of upper and lower stages.

Each cavity 32 has a rectangular cross-section corresponding to the outer peripheral shape of the terminal connecting portion 21 and extends in the front-rear direction according to a length of the terminal connecting portion 21. A front stop wall (not shown) is formed in a front end part of the cavity 32 for restricting a forward movement of the terminal 20.

Figure 6:
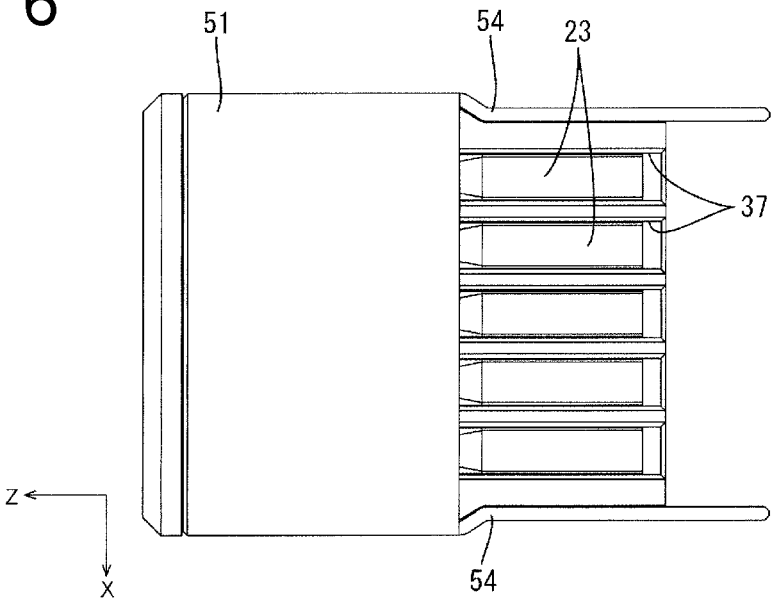
FIG. 6 is a plan view showing the communication connector in the state where the second shield case and the shield cable are removed.

The extending portion 36 extends rearward from the rear end of the housing body 31. As shown in FIGS. 4 and 6, the extending portion 36 includes placing grooves 37 arranged such that the wire connecting portions 23 of the respective terminals 20 can be placed therein. Each placing groove 37 includes a bottom surface 37A and groove walls 37B rising from both side edges of the bottom surface 37A. The placing grooves 37 are formed laterally side by side on each of the upper and lower surfaces of the extending portion 36 according to the number of the terminals 20.

(Shield Case 50)

Figure 1:
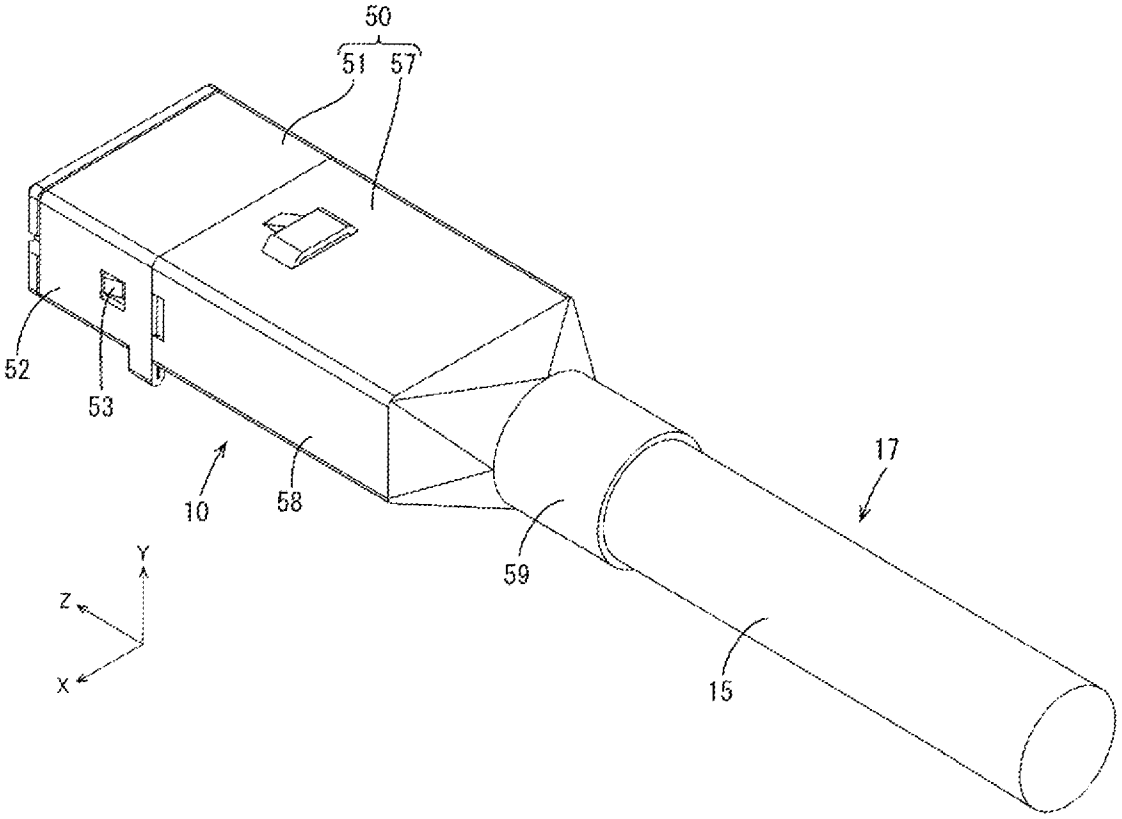
FIG. 1 is a perspective view showing a communication connector according to one embodiment of the present invention.

As shown in FIG. 1, the shield case 50 includes a first shield case 51 for covering the housing body 31 and a second shield case 57 disposed behind the first shield case 51 for covering the wires 11 to 14. Further, the shield case 50 is connected electrically to ground. The first shield case 51 is, for example, made of metal such as copper or copper alloy and, as shown in FIG. 2, includes a housing surrounding portion 52 in the form of a rectangular tube surrounding the housing 30 and connecting portions 54 to be connected electrically to the second shield case 57.

Resiliently deformable locked portions 53 are provided on left and right side surfaces of the housing surrounding portion 52. When the first shield case 51 is fit to the housing 30 from behind the housing 30, the locked portions 53 are locked to locking portions (not shown) formed by cutting side surfaces of the housing 30. The connecting portions 54 are plate-like parts extending rearward from the rear ends of the side surfaces of the housing surrounding portion 52, and are connected electrically to the second shield case 57 by contacting inner surfaces of the second shield case 57.

The second shield case 57 is made of metal such as copper or copper alloy and includes, as shown in FIG. 1, a box-shaped wire shielding portion 58 open on a front side and a hollow cylindrical shield connecting portion 59 to be fit externally on the shield cable 17. The wire shielding portion 58 surrounds all of the wires 11 to 14. The shield connecting portion 59 is, for example, connected to the shield layer 18 folded outside the insulation coating 15 at an end part of the shield cable 17. The shield connecting portion 59 and the shield layer 18 can be fixed, for example, by welding or crimping.

Figure 7:
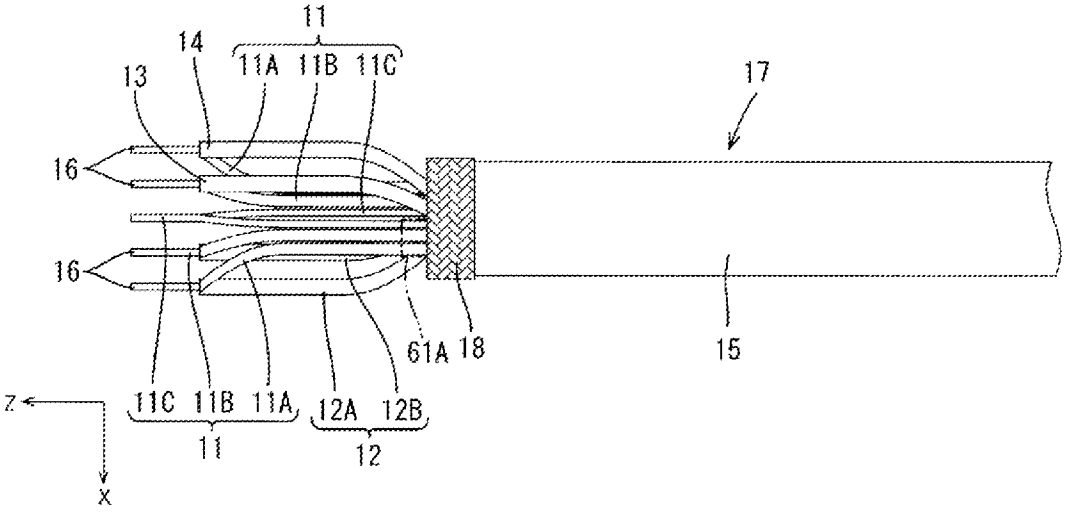
FIG. 7 is a plan view showing a state where an insulation coating is stripped at an end part of the shield cable.

Next, a method for manufacturing the communication connector 10 is described. First, as shown in FIG. 7, the end parts of the first shield member 61, the shield layer 18 and the insulation coating 15 are stripped in the shield cable 17 to expose the end parts of the wires 11 to 14 on the side of the terminals 20. At this time, the end part 61A (shown by chain double-dashed line in FIG. 7) of the first shield member 61 is exposed. Further, the end part of the shield layer 18 is folded onto the outer peripheral surface of the insulation coating 15. Subsequently, the insulation layers of the respective wires 12 to 15 excluding the drain wires 11C are stripped using a wire stripper or the like, thereby exposing conductor parts 16 to be connected to the terminals 20.

Figure 8:
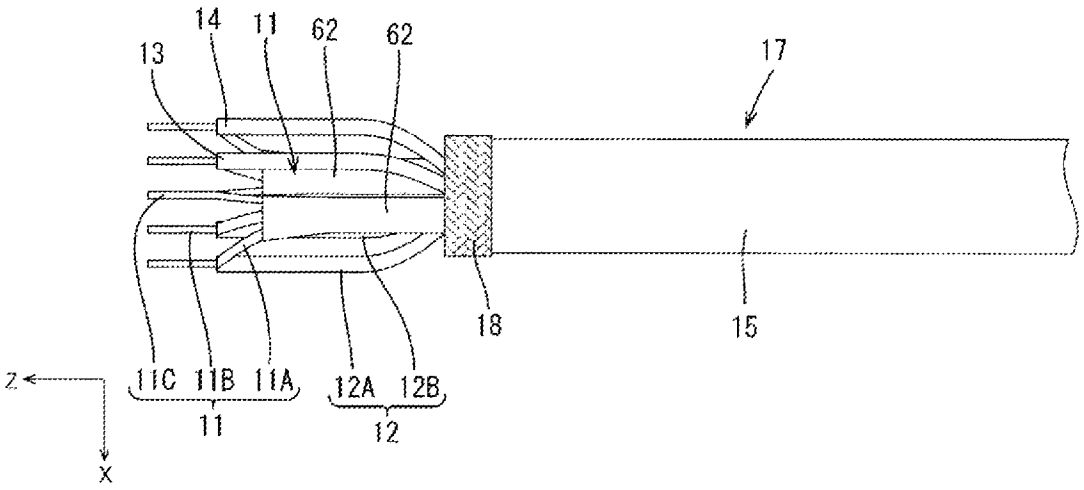
FIG. 8 is a plan view showing a state where a second shield member is wound on the shield cable.

Subsequently, as shown in FIG. 8, the second shield member 62 is wound on the wires 11A, 11B and the drain wire 11C. Note that a length Z1 (see FIG. 9) of the second shield member 62 in a Z-axis direction can be set appropriately, but it is, for example, preferable that a difference between the length Z1 and a length Z2 of sections of the exposed parts 19A, 19B covered with the insulation layers is 3 mm or shorter.

Subsequently, as shown in FIG. 3, the conductor parts 16 of the wires 11 to 14 are connected to the wire connecting portions 23 of the terminals 20 by soldering, welding or the like. Thereafter, the first shield case 51 is mounted on the housing 30, and the second shield case 57 is attached to the first shield case 51. In this way, the communication connector 10 is completed.

According to this embodiment, end parts of the wires 11, 12, 13 and 14 on the side of the terminals 20 are exposed parts not covered with the insulation coating 15. This enables each wire 11, 12, 13, 14 to be bent easily at the end part and easily connected to each terminal 20. The exposed parts 19A, 19B of the wires 11A, 11B are covered with the second shield member 62, and the second shield case 62 is connected electrically to the first shield case 61. This can suppress a situation where an impedance changes between the parts covered with the insulation coating 15 and the exposed parts 19A, 19B in the wires 11A, 11B and can suppress a reduction of communication quality.

In the case of a configuration not including the second shield member 62, the exposed parts 19A, 19B are arranged to directly face the wire shielding portion 58 of the shield case 50. This makes a distance of the exposed parts 19A, 19B to ground longer than distances of the other parts to ground and can change an impedance. In this embodiment, such a situation can be suppressed by including the second shield case 62.

The wires 11, 12, 13 and 14 include the drain wires 11C to be electrically connected to the first shield members 61, thereby further reducing the influence of noise by electrically connecting the drain wires 11C to ground.

The of wires 11A, 11B are twisted with each other to form a twisted pair cable in the part covered with the insulation coating 15 thereby reducing noise relating to the pair of wires 11A, 11B. Further, by winding the second shield member 62 on the wires 11A, 11B, it is possible to suppress a situation where an interval between the wires 11A, 11B partly changes and a situation where an impedance of the cable changes.

The invention is not limited to the above described and illustrated embodiment. For example, the following embodiments also are included in the scope of the invention.

The materials of the first and second shield members 61, 62 are not limited to those illustrated in the above embodiment and can be changed.

The number and arrangement of the wires of the shield cable 17 are not limited to those illustrated in the above embodiment and can be changed.

Although the wires 11A, 11B and the drain wire 11C are collectively surrounded by the first and second shield members 61, 62 in the above embodiment, there is no limitation to this. For example, only the wires 11A, 11B may be surrounded by the first and second shield members 61, 62. Further, the wires 11A, 11B wound with the first and second shield members 61, 62 and the drain wire 11C may be collectively surrounded by an insulating tape.

The wires 11A, 11B of the twisted pair are surrounded by the first and second shield members 61, 62 in the above embodiment. However, it is sufficient to surround at least one wire by the first and second shield members 61, 62.

The wires 11A, 11B may be twisted with each other in the part not covered with the insulation coating 15.

The shield members 61, 62 only need to be electrically connected and may not be directly in contact.

LIST OF REFERENCE SIGNS

10: communication connector
11, 12, 13, 14: a plurality of wires
11A, 11B: first and second wires
11C: drain wire
15: insulation coating
19A: exposed part in one wire
20: terminal
30: housing
61: first shield member
62: second shield member

The invention claimed is:

1. A communication connector, comprising:

wires for transmitting communication signals, each of the wires having a first end;

a shield layer collectively surrounding portions of the wire so that the first ends of the wires are exposed from the shield layer;

an insulation coating covering an outer periphery of the shield layer and a folded portion of the shield layer folded over an end of the insulation coating so that the folded portion of the shield layer contacts an outer periphery of the insulation coating;

terminals connected to the respective first ends of the wires;

a housing for accommodating the terminals;

a shield case assembly connected to the folded portion of the shield layer, the shield case assembly including a first shield case for covering the housing and a second shield case for covering the wires;

a conductive first shield member interposed between at least one of the wires and the insulation coating so that a first end of the conductive first shield member is exposed from the insulation coating; and a conductive second shield member disposed between exposed parts of the wires and the second shield case for surrounding the exposed parts of the wires, the conductive second shield member having a first end that at least partially overlaps the first end of the conductive first shield member to electrically connect the conductive first shield member and the conductive second shield member.

2. The communication connector of claim 1, wherein the wires include a drain wire to be connected electrically to the first shield member.

3. The communication connector of claim 2, wherein:

the wires include first and second wires adjacent to one another;

the first wire and the second wires constitute a twisted pair cable by being twisted with each other in a part covered with the insulation coating; and the second shield member is configured to surround the first wire and the second wire.

* * * * *